US006019015A

United States Patent [19]

Elton

[11] Patent Number: 6,019,015

[45] Date of Patent: Feb. 1, 2000

[54] ADJUSTABLE ACCELERATOR PEDAL

[75] Inventor: Robert Douglas Elton, Ann Arbor, Mich.

[73] Assignee: General Motors Corporation, Detroit, Mich.

[21] Appl. No.: 09/021,976

[22] Filed: Feb. 11, 1998

[51] Int. Cl.[7] ..... G05G 1/14

[52] U.S. Cl. ..... 74/513; 74/512; 74/560

[58] Field of Search ..... 74/513, 512, 560, 74/562, 478

[56] References Cited

U.S. PATENT DOCUMENTS

| | | | |
|---|---|---|---|
| 3,151,499 | 10/1964 | Roe | 74/512 |
| 3,631,739 | 1/1972 | McArthur et al. . | |
| 3,643,524 | 2/1972 | Herring . | |
| 3,643,525 | 2/1972 | Gibas . | |
| 3,828,625 | 8/1974 | Bruhn, Jr. . | |
| 3,975,972 | 8/1976 | Muhleck . | |
| 4,546,667 | 10/1985 | Bopst, III . | |
| 4,870,871 | 10/1989 | Ivan . | |
| 4,875,385 | 10/1989 | Sitrin . | |
| 5,010,782 | 4/1991 | Asano et al. . | |
| 5,056,742 | 10/1991 | Sakurai . | |
| 5,078,024 | 1/1992 | Cicotte et al. . | |
| 5,086,663 | 2/1992 | Asano et al. . | |
| 5,351,573 | 10/1994 | Cicotte . | |
| 5,460,061 | 10/1995 | Redding et al. . | |
| 5,497,677 | 3/1996 | Baumann et al. . | |

FOREIGN PATENT DOCUMENTS

| | | | |
|---|---|---|---|
| 63-54615 | 3/1988 | Japan | 74/512 |

*Primary Examiner*—Tamara L. Graysay
*Assistant Examiner*—William C Joyce
*Attorney, Agent, or Firm*—Kathryn A. Marra

[57] ABSTRACT

An adjustable pedal mechanism for automotive vehicles includes a pivoting presenter arm with a swinging lower end that provides a pivot for a pedal actuating mechanism. A link connecting the actuating pedal with the operated device, such as an accelerator throttle or power control cable, extends essentially parallel to the presenter arm. the link has a length equal to that of the presenter arm so that pivoting of the presenter arm to move the pedal pivot point forward or back causes an equivalent pivoting motion of the link and thereby maintains the pedal attitude constant over a substantial range of adjustment positions. By making the presenter arm of substantial length and limiting its angular adjustment motion on either side of a vertical line, the height of the pedal above the vehicle floor is maintained relatively constant over the total range of adjustment of the pedal position.

6 Claims, 3 Drawing Sheets

ADJUSTABLE ACCELERATOR PEDAL

TECHNICAL FIELD

This invention relates to adjustable pedals for vehicles and more particularly to an adjustable accelerator pedal mechanism with an extended range of adjustment travel.

BACKGROUND OF THE INVENTION

The majority of automotive vehicles currently available are provided with accelerator pedals and other operating pedals located in relatively fixed positions with a fixed extent of operating motion. They cannot be adjusted closer to or farther away from the driver. A small percentage of vehicles have been offered with adjustable pedals. In general these pedals have shared the same operating axis as the fixed pedals. The adjusting system effectively lengthened or shortened the operating link between the pedal arm and the brake booster or the accelerator cable attachment. The systems have the shortcoming that the pedal also rises and lowers when adjusted rearward and forward, respectively.

SUMMARY OF THE INVENTION

The present invention provides a solution to these problems by providing an adjustable pedal mechanism for automotive vehicles which utilizes a pivoting presenter arm with a swinging lower end that provides a pivot for a pedal actuating mechanism. A link connecting the actuating pedal with the operated device, such as an accelerator throttle or power control cable, extends essentially parallel to the presenter arm. The link has a length essentially equal to that of the presenter arm so that pivoting of the presenter arm to move the pedal pivot point forward or back causes an equivalent pivoting motion of the link and thereby maintains the pedal attitude constant over a substantial range of adjustment positions. By making the presenter arm of substantial length and limiting its angular adjustment motion on either side of a vertical line, the height of the pedal above the vehicle floor is maintained relatively constant over the total range of adjustment of the pedal position.

These and other features and advantages of the invention will be more fully understood from the following description of certain specific embodiments of the invention taken together with the accompanying drawings.

DESCRIPTION OF THE PREFERRED EMBODIMENT

Figure 1:
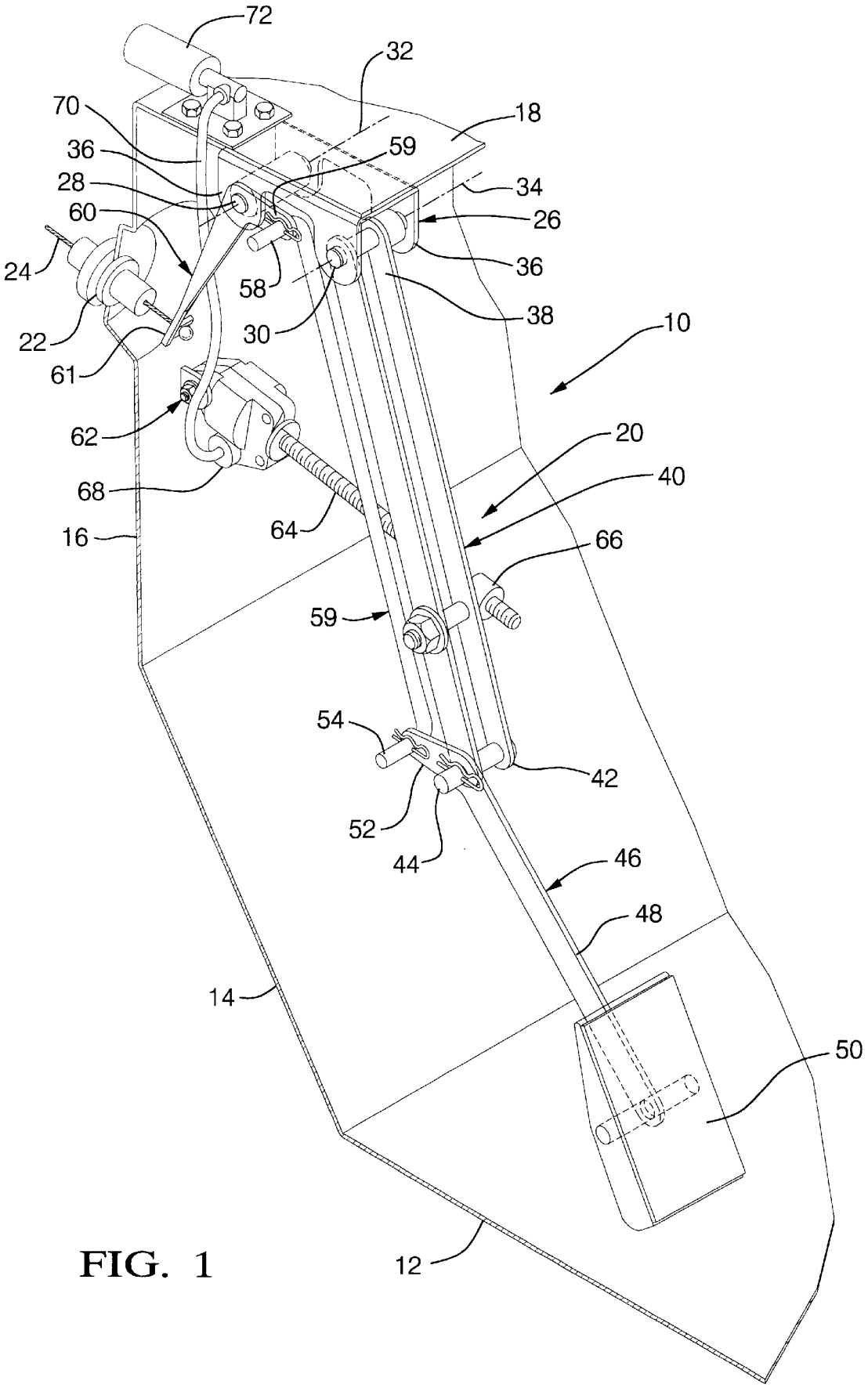
FIG. 1 is a fragmentary perspective view of an adjustable accelerator pedal mechanism according to the invention.

Referring now to the drawings in detail, numeral 10 generally indicates an automotive vehicle body having an enclosure including a floor 12, toe panel 14, dash panel 16, and an upper mounting panel 18. These portions of the body 10 comprise a support portion of an adjustable pedal mechanism to be subsequently described. Alternatively, the mechanism 20 could be mounted to separate bracket means to form a module installable in the vehicle body as a separate pre-mounted mechanism, or support for the mechanism could be provided by any other suitable means.

Figure 2:
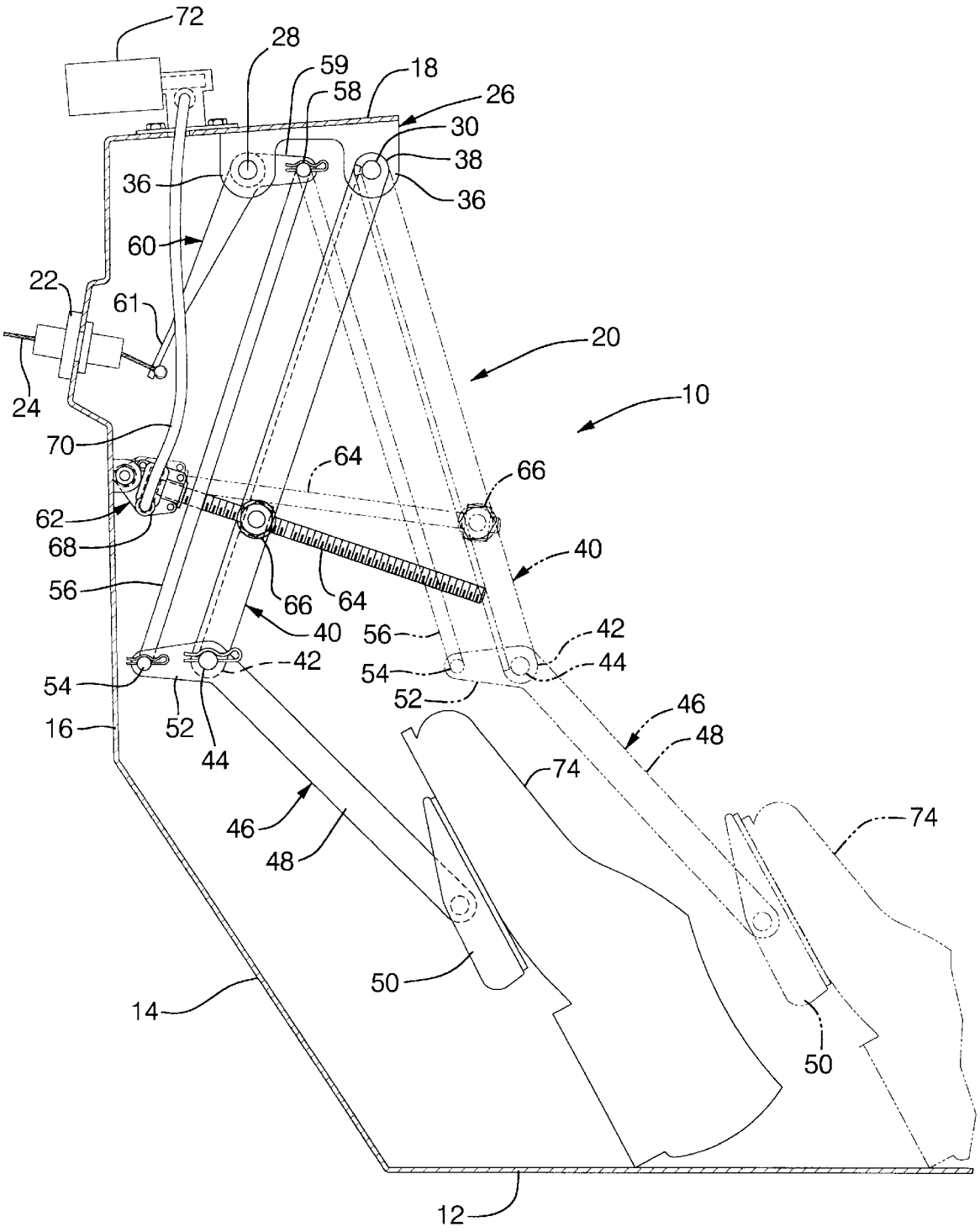
FIG. 2, is a side view illustrating the forward and rearward extreme positions of adjustment of the pedal mechanism of FIG. 1.

The dash panel 16, mounts a bushing 22 through which extends an accelerator cable 24 connected with a vehicle throttle or other power control means, not shown. FIGS. 1 and 2 of the drawings show the accelerator cable 24 in the idle position wherein it is slid to its farthest forward position within the bushing 22. Drawing FIG. 1 shows the pedal mechanism 20 positioned near the rear limit of its adjustment range while FIG. 2 shows the full range of adjustment of the mechanism.

The adjustable pedal mechanism 20 includes a bracket 26 secured to the upper mounting panel 18 and supporting a front pivot pin 28 and a rear pivot pin 30 spaced longitudinally on parallel lateral axes 32, 34 respectively and carried in depending ears 36 of the bracket. Bracket 26 may be welded or otherwise attached to the upper mounting panel 18.

The rear pivot pin 30 pivotally supports an upper end 38 of a presenter arm generally indicated by numeral 40. Presenter arm 40 includes a channel member connecting the upper end 38 with a lower end 42 carrying a lower pivot pin 44.

A pedal lever 46 is pivotally mounted on pin 44 and includes a downwardly extending pedal arm 48 pivotally connected at its lower end with a foot pedal 50. A control arm 52 of the pedal lever 46 extends forward from the pivot pin 44 and is pivotally connected with a lower end 54 of a link 56 extending generally parallel to a having and length essentially equal to that of the presenter arm 40.

At an upper end 58, link 56 is pivotally connected with a driven arm 59 of a bellcrank 60 which is pivotable on the front pivot pin 28. The driven arm 59 extends rearward and generally parallel with the forwardly extending control arm 52 of the pedal lever 46. Thus presenter arm 40, link 56, control arm 52 and driven arm 59 approximate a parallelogram linkage for a purpose to be subsequently made clear. Bellcrank 60 also has a control arm 61 that connects with the actuating end of the throttle cable 24.

The pedal mechanism 20 is further provided with adjustment means in the form of an actuator generally indicated by numeral 62. Actuator 62 includes a ballscrew 64 threadably engaging a nut 66 that is pivotally connected to the presenter arm 40 at a point intermediate its ends. The ballscrew 64 is selectively rotatably driven by a gear drive 68 that is in turn driven through a cable 70 by a gear motor 72 mounted on the upper surface of the mounting panel 18.

FIG. 2 best illustrates the operation of the mechanism 20 as pertains to its fore and aft adjustment by the actuator 62. The figure shows in solid lines the full forward position of the mechanism wherein the presenter arm 40 has been pivoted to its forward position and the foot pedal 50 is positioned at its closest point to the toe panel 14. Note that the pedal is positioned at a convenient height above the floor to be easily accessible to a driver's foot indicated by numeral 74.

To adjust the position of the foot pedal 50 rearward for comfortable positioning the gear motor 72 is actuated to rotate the baliscrew 64 and swingably pivot the presenter arm 40 rearwardly to any selected position within a range, the rear extent of which is indicated in phantom lines in FIG. 2. In this rear position, the foot pedal 50 is moved a significant amount rearward but is maintained at approximately the same height from the floor and presents to the driver's foot 74 an attitude similar to the position of the foot pedal 50 in the forward position. This is accomplished by the generally parallel relation of the presenter arm 40 and the link 56 which approximate a parallelogram linkage that maintains the pedal lever 46 in its same angular attitude throughout the whole range of swinging pivotal motion of the presenter arm 40. Note that the bellcrank 60 remains stationary throughout the full adjusting motion of the presenter arm and is shown in the idle position of the mechanism, wherein the throttle cable 24 is in its full forward position and the foot pedal 50 is correspondingly in its full rearward operating position.

Figure 3:
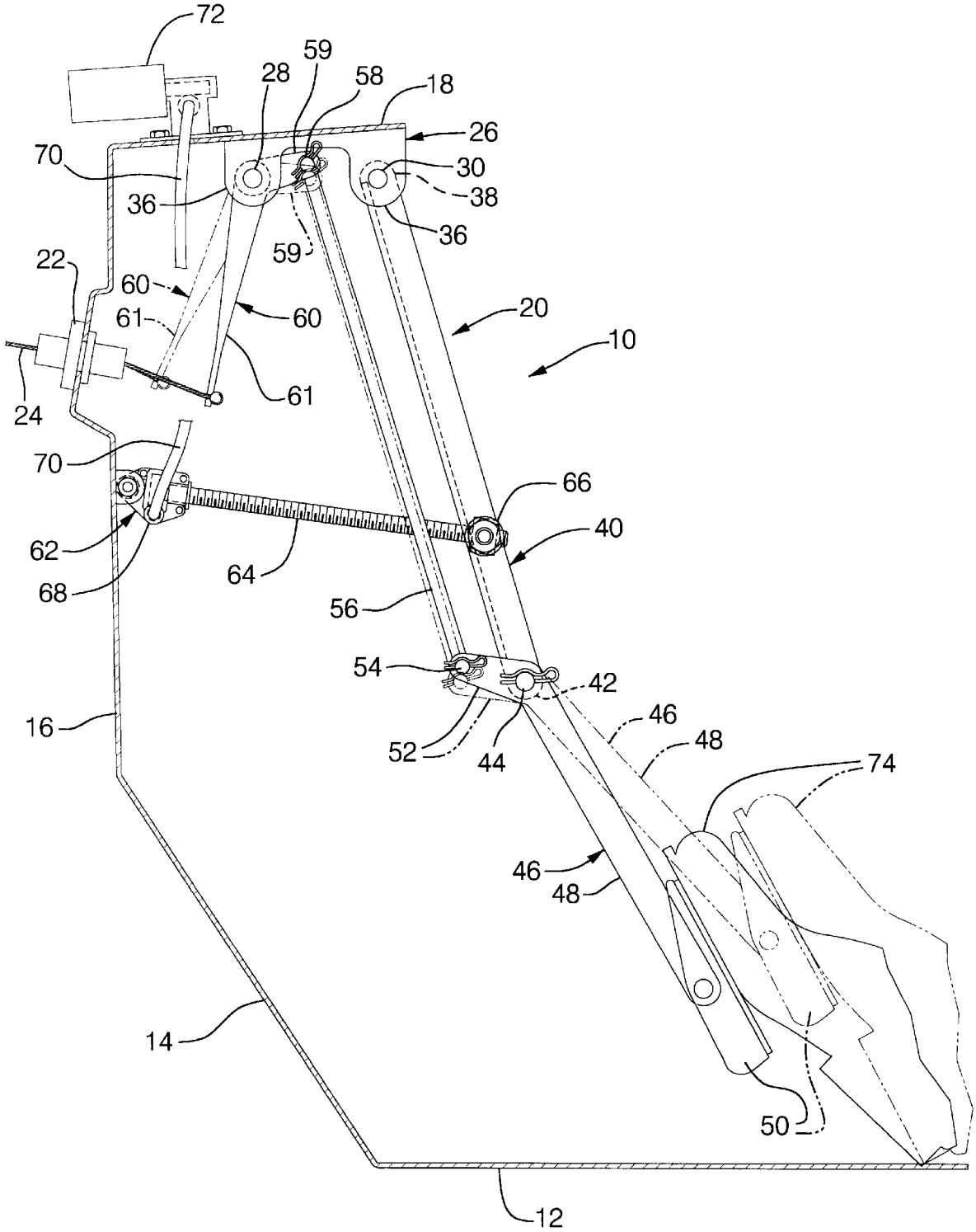
FIG. 3 is a view similar to FIG. 2 illustrating the actuating positions of the pedal in its rear position of operation.

FIG. 3 illustrates the operation of the adjustable pedal mechanism 20 in its movement of the throttle cable 24 between idle and full power positions as the driver's foot 74 presses forward on the foot pedal 50. The mechanism 20 is shown in solid lines in the full power position with the presenter arm 40 adjusted to its full rearward adjustment position- Note that in this full power position, the bellcrank 60 is pivoted counterclockwise so that the throttle cable 24 is pulled rearward to its fall power position and the foot pedal 50 is pushed forward to its full power position. As the driver's foot 74 is moved rearward, it reaches the idle position shown in phantom lines in FIG. 3. In this idle position, the pedal lever 46 has been pivoted counterclockwise, drawing the link 56 downward and pivoting the bellcrank 60 clockwise to relax the throttle cable 24 which is drawn forward by springs or other means not shown mounted on the vehicle power control.

Thus the mechanism of the current invention is shown to provide a relatively large range of fore and aft adjustment of the foot pedal without causing a significant change in the attitude or height of the foot pedal throughout the range of travel. There is thus provided an improved adjustable throttle pedal mechanism which provides for convenient adjustment of the pedal location to accommodate drivers of various leg lengths.

While the invention has been described by reference to certain preferred embodiments, it should be understood that numerous changes could be made within the spirit and scope of the inventive concepts described. Accordingly it is intended that the invention not be limited to the disclosed embodiments, but that it have the fuill scope permitted by the language of the following claims.

I claim:

1. An adjustable pedal mechanism for an automotive vehicle, said mechanism comprising:

a support having fixed front and rear pivots longitudinally spaced and extending on laterally extending parallel axes, said fixed pivot adapted to be spaced from the rear pivot toward the front of the vehicle;

a presenter arm having upper and lower ends, said upper end being pivotable on said rear pivot between forward and rear positions of said arm whereby the lower end is selectively swingable between corresponding forward and rear adjustment positions;

adjustment means separately connecting the presenter arm with said support and adjustable to selectively vary the position of said lower end between the forward and rear adjustment positions; and a pedal lever pivotally mounted on the lower end of the presenter arm, said lever including a downwardly extending pedal arm mounting a foot pedal at a lower end of the pedal arm and a forwardly extending control arm connected with a link lying generally parallel with and of a length essentially equal to the presenter arm;

said link being pivotally connected with a rearwardly extending driven arm of a bellcrank pivotally mounted on the front pivot of said support, said bellcrank having a control arm adapted to be connected with a control element of a power control;

whereby actuation of the foot pedal forward rotates the pedal lever about the lower end of the presenter arm which drives the link to pivot the bellcrank control arm rearward, moving the power control element in a power increasing direction, relaxation of foot pressure on the foot pedal allowing the power control to return the mechanism to an idle position, movement of the adjustment means pivoting the presenter arm to selectively position the foot pedal for actuating movement in any of a range of operating positions between forward and rear positions corresponding to the forward and rear adjustment positions of the lower end of the presenter arm.

2. An adjustable pedal mechanism as in claim 1 wherein said link and said presenter arm coact with the control arm of said pedal lever and the driven arm of said bellcrank to approximate a parallelogram linkage which maintains an essentially constant angular attitude of the pedal lever over the full range of said adjustment positions of the foot pedal.

3. An adjustable pedal mechanism as in claim 1 wherein said presenter arm is pivotable through a limited angular range on either side of a vertical position such that the vertical location of the foot pedal relative to the support is changed only a minimal amount over the full range of said adjustment positions of the foot pedal.

4. An adjustable pedal mechanism as in claim 1 wherein said adjustment means includes an actuator operatively connected between a fitting on said presenter arm intermediate its ends and a forward portion of the support, said actuator being operative to vary the distance between said fitting and said support portion.

5. An adjustable pedal mechanism as in claim 4 wherein said actuator is power operated.

6. An adjustable pedal mechanism as in claim 5 wherein said actuator includes a ballscrew.

* * * * *